US006488572B1

(12) United States Patent
Mason

(10) Patent No.: US 6,488,572 B1
(45) Date of Patent: Dec. 3, 2002

(54) METHOD AND APPARATUS FOR REMOVING MARINE ORGANISMS FROM A SUBMERGED SUBSTRATE

(76) Inventor: Dennis Mason, Sethøyen 61, Mjølkeràen (NO)

( * ) Notice: Subject to any disclaimer, the term of this patent is extended or adjusted under 35 U.S.C. 154(b) by 0 days.

(21) Appl. No.: 09/959,684

(22) PCT Filed: May 2, 2000

(86) PCT No.: PCT/NO00/00146

§ 371 (c)(1),
(2), (4) Date: Nov. 5, 2001

(87) PCT Pub. No.: WO00/68070

PCT Pub. Date: Nov. 6, 2000

Related U.S. Application Data

(60) Provisional application No. 60/133,030, filed on May 7, 1999.

(51) Int. Cl.[7] ..... B24B 1/00

(52) U.S. Cl. ..... 451/54; 451/55; 451/68; 451/353

(58) Field of Search ..... 457/28, 53, 54, 457/55, 67, 68, 92, 353; 210/170; 204/217, 147; 166/248; 114/312

(56) References Cited

U.S. PATENT DOCUMENTS 3,610,195 A 10/1971 Wilcox
3,766,032 A 10/1973 Yeiser
4,144,936 A * 3/1979 Evans ..... 166/55.6
4,196,064 A 4/1980 Harms
4,456,516 A * 6/1984 Schaffner ..... 204/217
5,240,674 A 8/1993 Armor
5,327,848 A 7/1994 Hannon
5,593,636 A 1/1997 Putz
5,804,065 A * 9/1998 Kolz ..... 210/170

* cited by examiner

*Primary Examiner*—Eileen P. Morgan
(74) *Attorney, Agent, or Firm*—Christian D. Abel

(57) ABSTRACT

A method and apparatus for removing marine fouling from underwater substrates such as ships' hulls (10). The method is characterized by the steps of first subjecting marine organisms such as barnacles to an electrical field of sufficent intensity to degrade the adhesive properties of the organisms to the substrate, and thereafter physically removing said organisms with the help of rotating brushes (16) or similar abrasive removal means. The apparatus is characterized in that it includes a remotely operated submarine (12) or other suitable transport means, such as a vehicle with a magnetized caterpillar track, having a forwardly mounted electrode (14) for imparting an electric field to the organisms together with abrasive removal means (16) mounted behind the electrode for removal of the organisms. A power source (18) is provided, having one pole (20) connected to substrate (10) and a second pole connected to electrode (14).

6 Claims, 4 Drawing Sheets

METHOD AND APPARATUS FOR REMOVING MARINE ORGANISMS FROM A SUBMERGED SUBSTRATE

This application is a 371 of PCT/NO00/00146 filed May 2, 2000, which claims benefit to Provisional Application No. 60/133,030 filed May 7, 1999.

TECHNICAL FIELD

This invention relates to the removal of marine fouling from structures exposed to a marine environment, and in particular ships' hulls.

BACKGROUND ART

The fouling of underwater structures by marine organisms is a well-known problem. Both static structures such as oil platforms, and mobile structures such as ships are affected. In the case of ships, the accumulation of marine growth can drastically reduce a vessel's speed and increase fuel consumption. As a result, ships must be regularly serviced to remove this growth. The servicing of ships, however, is very expensive, not only in terms of direct costs but also in lost revenues while the ship is idle. Consequently, increasing the speed with which this work is performed is critical.

Of the various types of organisms that comprise marine fouling, one of the post troublesome is the barnacle. This organism, which outwardly resembles a mollusk, is actually a crustacean, of the class cirripedia. In its larval stage, the barnacle attaches itself headfirst to a substrate such as a ship's hull, and thereafter constructs a shell composed of six calciferous plates. The animal attaches these plates to the substrate with one of the most powerful adhesives known in nature, which makes removal of the shell extremely difficult. Barnacles are particularly troublesome because these shells remain attached even after the animal is dead.

Various methods have been developed for killing marine growth, however these methods do not address the problem of removing the organisms after they have been killed. U.S. Pat. Nos. 5,327,848; 5,2401,674; and 5,593,636 disclose the use of heat for killing zebra mussels. These patents disclose that the use of temperatures in the order of 35–45 degrees Centigrade is sufficient to achieve adequate mortality. U.S. Pat. No. 5,804,065 discloses the use of a low-level electric field to kill marine growth. This patent teaches that subjecting zebra mussels to a field having a power density between about 3,500 to 50,000 microwatts/cubic centimeter for a time interval of about 24 to 72 hours is sufficient to achieve adequate mortality. These patents do not disclose, however, any effect on the adhesive properties of barnacle shells to a substrate, nor provide a means for the removal of such shells. In particular, the time intervals disclosed by U.S. Pat. No. 5,804,065 demonstrates that the technique disclosed therein is aimed at stopping the reproduction and propagation of the organisms, and is consequently unsuitable for the efficient cleaning of hulls or other substrates.

OBJECTS AND ADVANTAGES

It is therefore an object of the current invention to provide an apparatus and method for removing marine fouling from a substrate, in particular marine organisms such as barnacles, which attach to the substrate with the help of a natural adhesive. It is a further object of the invention to provide an apparatus and method that improves the speed and efficiency with which marine fouling can be removed. Still further objects and advantages will become apparent from a consideration of the ensuing description and drawings.

DISCLOSURE OF THE INVENTION

The present invention is directed to an improved method and apparatus that takes a novel approach for removing marine fouling from underwater structures such as ships' hulls. The method is characterized by the steps of first subjecting marine organisms such as barnacles to an electrical field of sufficient intensity to degrade the adhesive properties of the organisms to a substrate, and thereafter physically removing said organisms with the help of rotating brushes or similar abrasive removal means. The apparatus is characterized in that it includes a remotely operated submarine or other suitable transport means, such as a vehicle with a magnetized caterpillar track, having a forwardly mounted electrode for imparting an electric field to the organism= together with abrasive removal means mounted behind the electrode for removal of the organisms.

BRIEF DESCRIPTION OF THE DRAWINGS

Details of the invention are described in connection with the accompanying figures, wherein.

DETAILED DESCRIPTION OF THE PREFERRED EMBODIMENT

Figure 1:
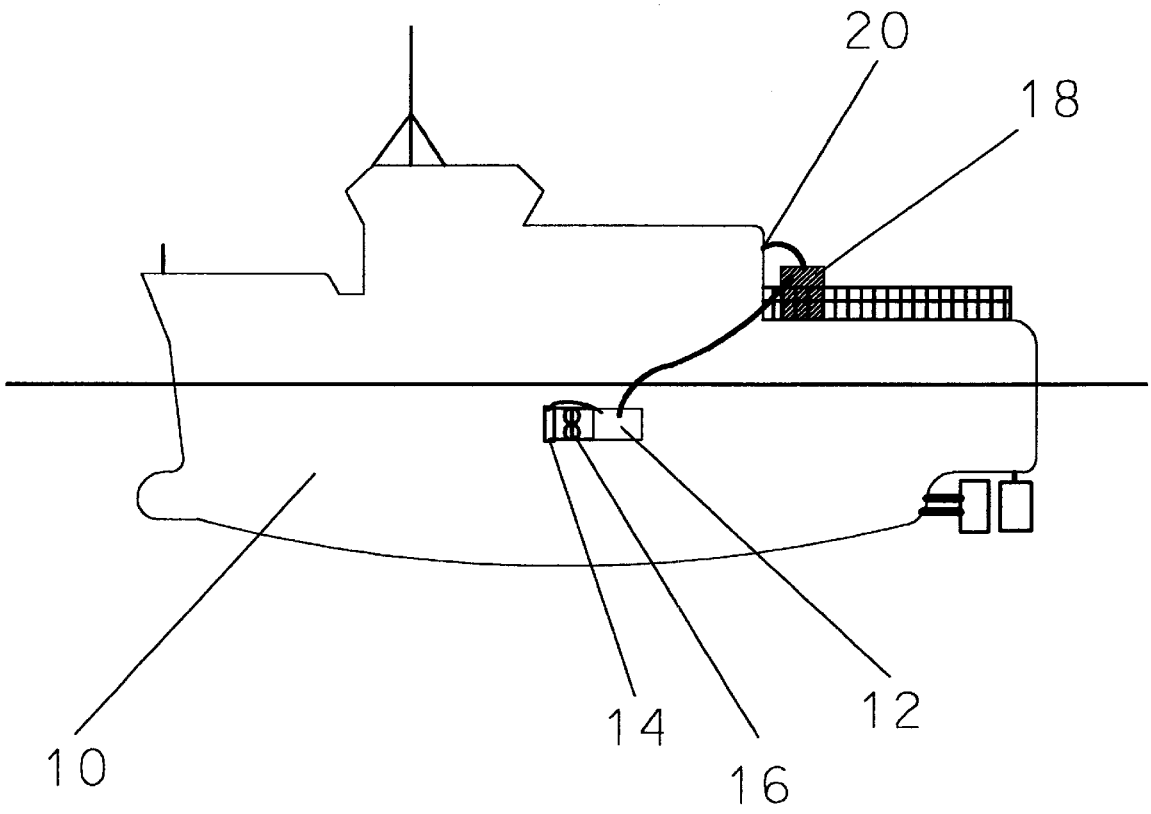
FIG. 1 is a side elevational view of a remotely operated submarine with a forwardly mounted electrode and brush arrangement in operation with a ship.
Figure 2:
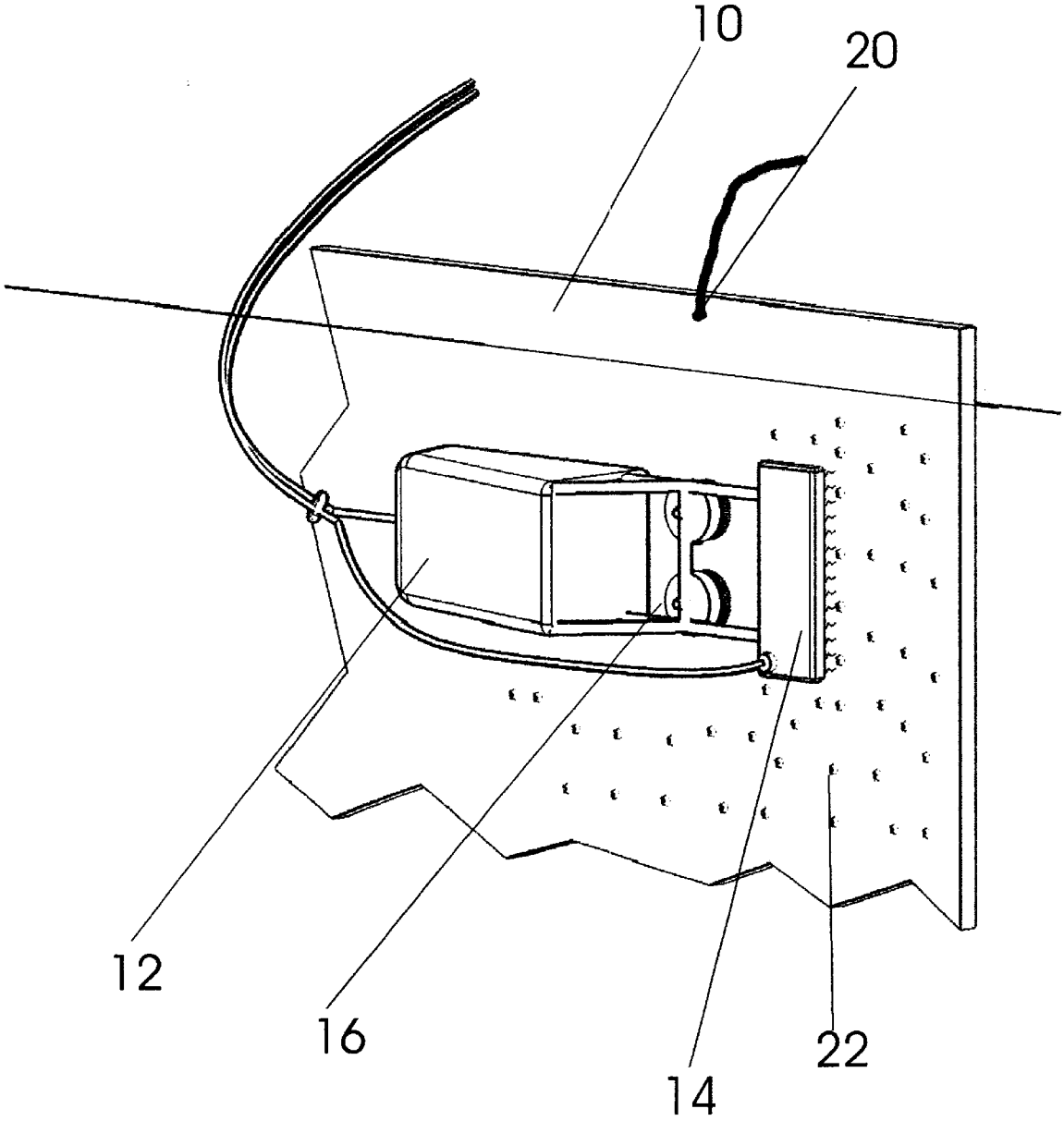
FIG. 2 is an enlarged perspective view of the remotely operated submarine from FIG. 1.
Figure 3:
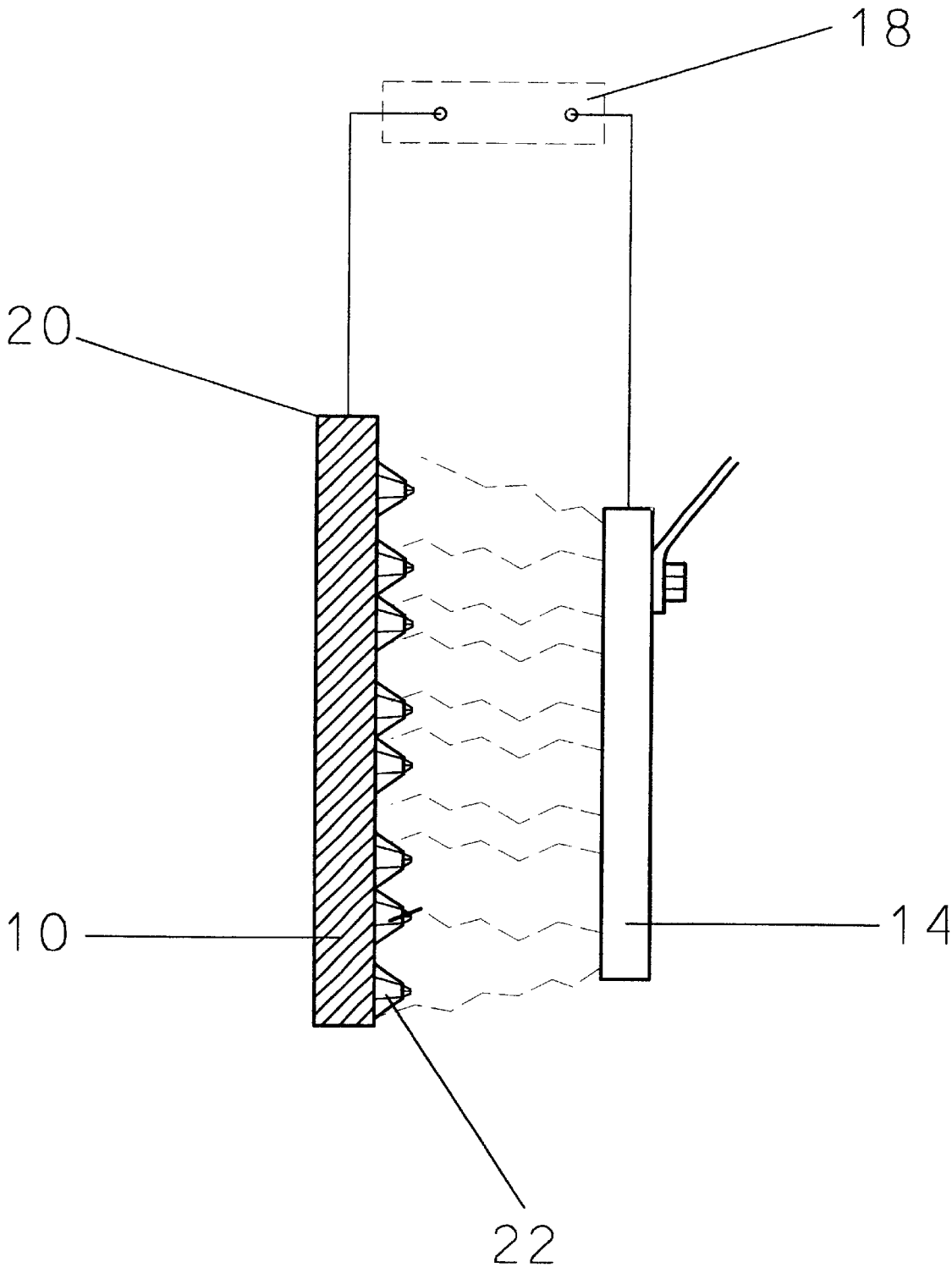
FIG. 3 is an enlarged elevational view of the electrode mounted on the remotely controlled submarine, showing lines of current impinging upon marine organisms.
Figure 4:
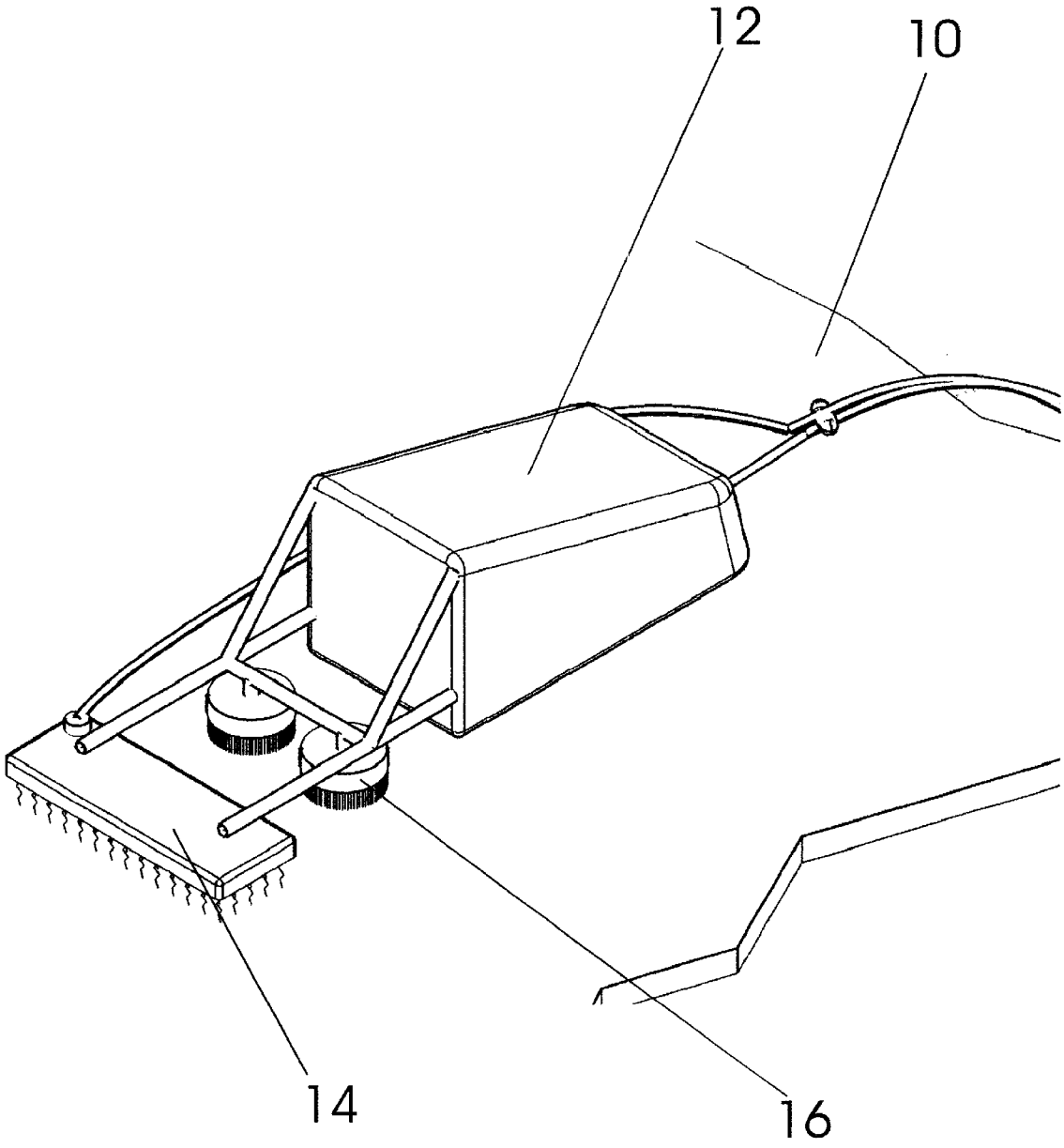
FIG. 4 is an enlarged perspective view of the remotely operated submarine.

Referring to the figures there is shown an apparatus for removal of marine fouling from a ship with a hull 10. The apparatus comprises a remotely controlled submarine 12 to which is connected a forwardly mounted electrode 14. Rotating brushes 16 are mounted on submarine 12 immediately behind electrode 14. The apparatus is connected to a power source 18, with a first pole 20 terminating at hull 10 and a second pole terminating at electrode 14. As depicted in FIG. 3, an electric current is caused to flow through a marine organism 22 when electrode 14 is brought within proximity to hull 10.

Empirical results have demonstrated that an electrical current of sufficient intensity will significantly reduce the adhesion of marine organisms such as barnacles to a substrate, such as hull 10. As a result, brushes 16 are capable of removing the organisms much more easily than is the case with known methods.

The mechanism that affects the adhesion of the barnacles is not precisely known. One possible explanation is that electrical resistance at the contact point between the barnacle and the substrate causes a localized heating, which in turn degrades the holding properties of the natural adhesive with which the barnacle attaches itself. Test results according to the following tables have demonstrated that the application of heat produces results similar to those observed with electrical currents. The test involved measuring the force required to physically remove randomly selected from a metallic substrate.

TABLE 1

| No heat applied | |
|---|---|
| Test barnacle | Measured force |
| 1 | 1.0 kg |
| 2 | 1.5 kg |
| 3 | 2.5 kg |
| 4 | 2.5 kg |
| 5 | 1.0 kg |
| 6 | 1.5 kg |
| average | 1.66 kg |

TABLE 2

| 250° C. | | |
|---|---|---|
| Test barnacle | Time sec | force |
| 1 | 3 | 0.1 kg |
| 2 | 3 | 0.0 kg |
| 3 | 3 | 0.5 kg |
| 4 | 3 | 0.5 kg |
| 5 | 3 | 0.1 kg |
| 6 | 3 | 0.0 kg |
| average | | 0.2 kg |

TABLE 3

| 100° C. | | |
|---|---|---|
| Test barnacle | Time sec | force |
| 1 | 2 | 1.5 kg |
| 2 | 10 | 0.1 kg |
| 3 | 10 | 0.5 kg |

Another possible explanation for the observed phenomenon, which may in fact work together with heat to produce the observed results, is that high velocity tons or bubbles produced by electrolysis attack the integrity of the adhesive.

In the preferred embodiment of the invention, an AC power source is employed in which opposite poles are attached to hull 10 and electrode 14 respectively. It is understood, however, that a DC power source could be employed. In another embodiment, electrode 14 could be replaced by one or more pairs of oppositely charged electrodes spaced relative to one another so as to create an electric field of desired intensity, which electric field could be placed in proximity to the organisms to achieve the required effect. It is further is understood that while the preferred embodiment envisions utilizing a remotely controlled submarine to transport electrode 14 and brushes 16 along hull 10, other transport means could equally be employed.

What is claimed is:

1. Method for the removal of marine organisms from a submerged substrate, comprising the steps of first subjecting said organisms to an electric current of sufficient intensity to degrade the adhesive properties of said organisms and thereafter physically removing said organisms with an abrasive removal means.

2. Method of claim 1, wherein said organisms are subjected to said electric current by the steps of connecting a first pole of a power source to said substrate, connecting a second pole of said power source to an electrode, and thereafter bringing said electrode within sufficient proximity of said substrate so as to create an electrical current flowing through said organisms.

3. Method of claim 2, wherein said electrode is mounted on an underwater transport means, and wherein said abrasive removal means is mounted on said underwater transport means behind said electrode.

4. Method of claims 3, wherein said underwater transport means is a remotely controlled submarine and wherein said abrasive removal means are rotating brushes.

5. Apparatus for removing marine organisms from a submerged substrate, comprising:

a) An underwater transport means b) an electrode mounted on said underwater transport means c) abrasive removal means mounted to said underwater transport means behind said electrode d) a power source with a first pole connected to said substrate and a second pole connected to said electrode, said power source being of sufficient strength to create an electric current flowing through said organisms, when said electrode is brought within close proximity to said substrate, of sufficient intensity to degrade the adhesive properties of said organisms.

6. Apparatus according to claim 5, wherein said underwater transport means is a remotely controlled submarine and wherein said abrasive removal means are rotating brushes.

* * * * *